US005569894A

United States Patent [19]

Uchida et al.

[11] Patent Number: 5,569,894

[45] Date of Patent: Oct. 29, 1996

[54] CIRCUIT BREAKER ARC QUENCHING DEVICE WITH VENTING STRUCTURE INCLUDING FLAPPER VALVE

[75] Inventors: Naoshi Uchida; Akihiko Kohanawa; Masao Miura; Jun Oyama; Koji Asakawa, all of Kawasaki, Japan

[73] Assignee: Fuji Electric Co., Ltd., Kawasaki, Japan

[21] Appl. No.: 441,835

[22] Filed: May 16, 1995

[30] Foreign Application Priority Data

May 24, 1994 [JP] Japan ..... 6-133662

[51] Int. Cl.[6] ..... H01H 9/36; H01H 33/53

[52] U.S. Cl. ..... 218/27; 200/306; 218/35; 218/36; 218/157

[58] Field of Search ..... 218/8–42, 155–158; 335/8, 10, 16, 147, 195, 201, 202; 200/304–306

[56] References Cited

U.S. PATENT DOCUMENTS

| | | | |
|---|---|---|---|
| 2,446,859 | 8/1948 | Traver et al. | 218/40 |
| 3,626,127 | 12/1971 | Baldini | 218/34 |
| 4,539,451 | 9/1985 | Mori et al. | 218/22 |
| 4,631,376 | 12/1986 | Leone | 218/157 X |
| 4,743,720 | 5/1988 | Takeuchi et al. | 218/24 |
| 4,876,424 | 10/1989 | Leone et al. | 218/155 X |
| 5,164,560 | 11/1992 | Uchida et al. | 218/20 |
| 5,206,614 | 4/1993 | Carothers | 218/41 |

FOREIGN PATENT DOCUMENTS

| | | | |
|---|---|---|---|
| 62-93829 | 4/1987 | Japan | H01H 73/18 |
| 63-133422 | 5/1988 | Japan | H01H 73/18 |
| 2-132716 | 5/1990 | Japan | H01H 9/36 |

*Primary Examiner*—J. R. Scott

*Attorney, Agent, or Firm*—Kanesaka & Takeuchi

[57] ABSTRACT

An arc quenching device for a circuit breaker having a stationary contact member and a moving contact member includes a magnetic element formed of an arc quenching core and a base plate. The arc quenching core includes a back wall, and two side walls extending from lateral sides of the back wall. The base plate extends substantially perpendicularly from a lower side of the back wall in a direction as in the side walls, and is fixed to the stationary contact member. The base plate includes a U-shaped magnetic driving core situated near a stationary contact point and extending upwardly from the base plate to surround the stationary contact point, and an arc horn integrally formed with the base plate and obliquely extending toward the back wall from a portion near the stationary contact point. Arc formed between the stationary contact member and the moving contact member is moved by magnetic driving force formed by the magnetic driving core to the arc quenching core to be quenched therein through the arc horn.

8 Claims, 3 Drawing Sheets

CIRCUIT BREAKER ARC QUENCHING DEVICE WITH VENTING STRUCTURE INCLUDING FLAPPER VALVE

BACKGROUND OF THE INVENTION AND RELATED ART STATEMENT

The present invention relates to a circuit breaker, such as circuit breaker for wiring, earth leakage breaker or the like, and specifically relates to an electromagnetic repulsion type arc quenching device of a circuit breaker.

The so-called de-ion type arc quenching device shown in FIG. 6 is well known as this sort of an arc quenching device for a circuit breaker. This arc quenching device 1 is structured such that magnetic plates 3 with V-shaped cut-offs or notches for allowing a moving contact member 2 to pass are piled up with adequate spacings and are supported with side walls 4 made of an insulation material. The magnetic plates 3 are fixed to the side walls by adhering or press-fixing.

FIG. 7 shows a longitudinal sectional view of a circuit breaker with the de-ion type arc quenching device in a power supply side. A stationary contact member 6 formed integrally with a power supply terminal 5 is bent back into a U-shape along a moving contact member 2, and a stationary contact 8 contacting a moving contact 7 of the moving contact member 2 is attached at an end of a bent back part *6a* of the stationary contact member 6. And, an arc horn 9, which leads an arc caused between the moving contact 7 and the stationary contact 8 toward the arc quenching device 1, is attached to the stationary contact member 6.

As is well known, a current flowing through the bent back part *6a* of the stationary contact member 6 and a current flowing through the moving contact member 2 positioned parallel to the bent back part flow in opposite directions as shown by arrows A in the figure. Therefore, owing to an electromagnetic repulsion force acting between these currents, the moving contact member 2 is sprung up by this electromagnetic repulsion force if a large current, such as a short-circuit current etc., flows. As a result, the moving contact member 2 is driven by a current limiting mechanism 10 and is quickly opened to the position shown by a chain line in the figure without awaiting the operation of a switching mechanism 11. Further, the arc 12 caused between the moving contact 7 and the stationary contact 8 receives the force toward the direction shown by an arrow B by a magnetic field of the current flowing through the bent back part *6a*, and is urged deeply into the arc quenching device 1. This arc 12 is elongated in the arc quenching device 1 to raise the arc voltage, and then, the arc is quenched in a short time.

However, this sort of arc quenching device requires a complicated work for fixing many magnetic plates 3 to the side walls 4 and high cost. In addition, there are problems such that when a large current is cut or broken, the surface of the magnetic plate is melted by arc heat, and metal particles thus formed are attached to the surface of the contacts resulting in abnormal temperature rise, or attached to the switching mechanism resulting in impeding normal operation of the switching mechanism.

On the other hand, in the electromagnetic repulsion type circuit breakers shown in FIG. 7, a magnetic driving core of a U-shape is attached crosswise to the bent back Dart *6a* of the stationary contact member, and magnetic flux generated by the current flowing through the bent back part is concentrated on the magnetic driving core so as to enhance action of magnetic field to an arc. This circuit breaker is disclosed in Japanese Laid Open Patent Publication (Kokai) No. 02-132716 and so on. In this circuit breaker of the prior art, the magnetic driving core is attached to the stationary contact member separately from the arc quenching device to thereby complicate the structure.

In Japanese Laid Open Patent Publication (Kokai) No. 62-93829, an arc quenching device includes a U-shape magnetic element having gas exhaust holes at a back plate and an insulating material for covering the magnetic element, which is formed separately from electric contacts. Also, in Japanese Laid Open Patent Publication (Kokai) No. 63-133422, an arc quenching device includes a U-shape magnetic element, and an insulating material for covering the magnetic element and forming heat decomposing gas by the arc. A fixed contact is formed separately from the magnetic element, but may extend to the magnetic element to form a separation plate for the magnetic element.

In viewing the foregoing, an object of the present invention is to provide an arc quenching device of a circuit breaker, which has no piled magnetic plates, and therefore, is simple in manufacturing and causes little damages by arc heat.

Another object of the present invention is to provide an arc quenching device of a circuit breaker, which simplifies its structure by integrally providing an arc quenching device with a magnetic driving core and an arc horn.

SUMMARY OF THE INVENTION

The objects of the present invention are achieved by an arc quenching device for a circuit breaker, which is comprised of a moving contact member; a stationary contact member bent back into a U-shape along the moving contact member; and a stationary contact attached to the end of a bent back part of the stationary contact member. The arc quenching device includes a magnetic element. The magnetic element includes an arc quenching core having a back wall and two side wall formed on both sides of the back wall, i.e. similar to C-shape, in its horizontal section, and a base plate orthogonal to the back wall of the arc quenching core and extending horizontally. The magnetic element is attached to the under surface of the bent back part of the stationary contact member through the base plate.

It is preferable to provide the magnetic element formed integrally with a magnetic driving core bent into a U-shape with its arms standing up on both sides of the base plate. It is also preferable to cut and bend a part of the base plate obliquely upward so as to provide the magnetic element formed integrally with an arc horn. Accordingly, the magnetic element can be integrally formed with the arc quenching core, the magnetic driving core, and the arc horn.

In the present invention, the arc quenching device is structured with the arc quenching core similar to C-shape in its horizontal section, and the arc quenching device is jointed to the under surface of a bent back part of the stationary contact member through the base plate extending horizontally and in orthogonal to a back wall of the arc quenching core. An arc is urged or driven toward the arc quenching core by a magnetic field caused by a current flowing through the bent back part of the stationary contact member, and is shut in the arc quenching core by magnetic flux generated by the arc itself through a C-shaped magnetic path of the arc quenching core, in an elongated state of the arc. Then, the arc is cooled by a wall surface of the arc quenching core so as to raise arc voltage, so that the arc is quenched in a short time.

The magnetic element of the arc quenching core is easily made by press forming without piling up magnetic plates. Also, this magnetic element is hardly melted by arc heat because of less contacts with the arc quenching core owing to the C-shape, compared with the conventional de-ion type arc quenching device in which the arc extends crosswise to the magnetic plates. A magnetic driving core and an arc horn can be simultaneously formed with the magnetic element with the arc quenching core so as to strengthen a magnetic driving force. In this case, since all these parts can be integrally formed, the structure is much simplified.

DETAILED DESCRIPTION OF A PREFERRED EMBODIMENT

Figure 1:
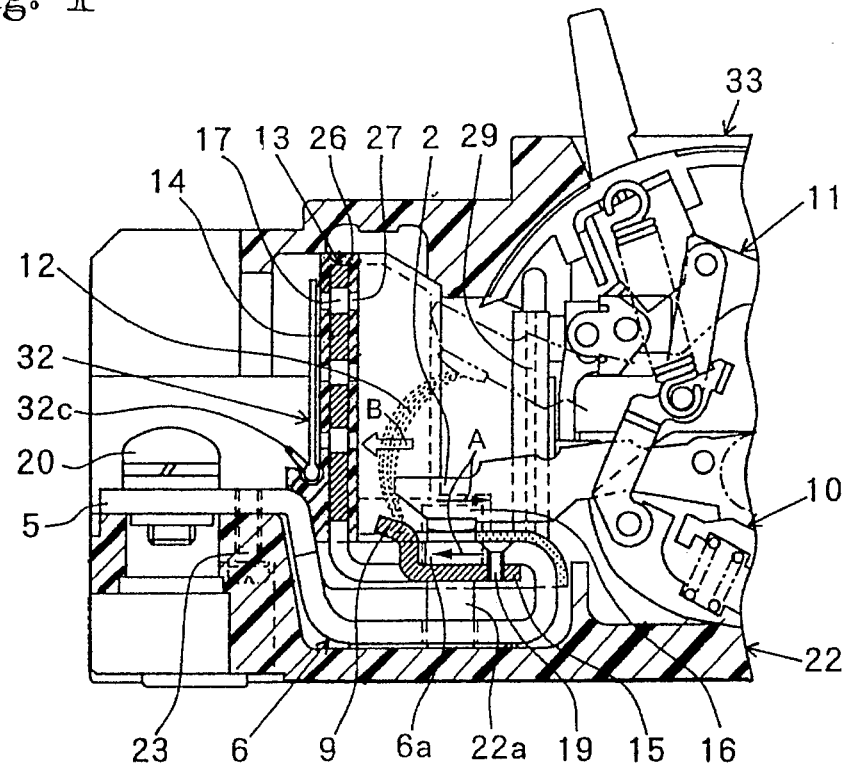
FIG. 1 is a longitudinal section view of a main portion of a circuit breaker in an embodiment of the present invention.
Figure 2:
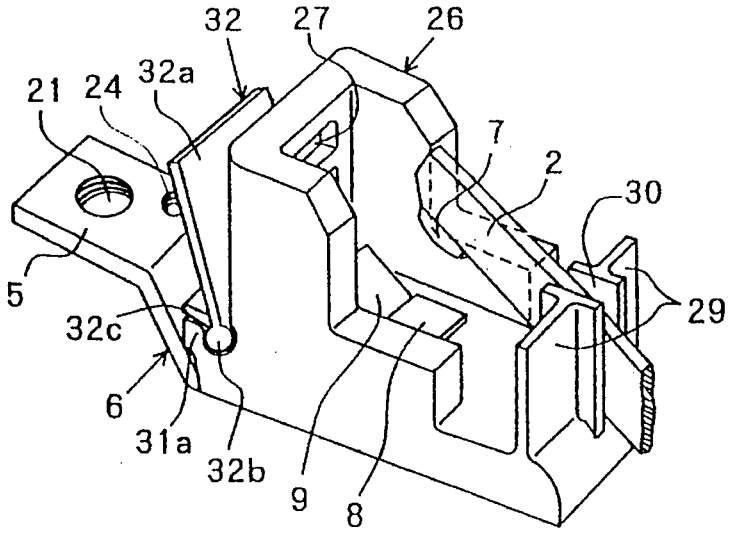
FIG. 2 is a perspective view of an arc quenching device of the circuit breaker shown in FIG. 1.
Figure 3:
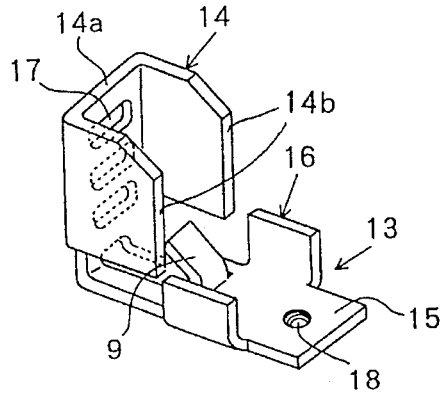
FIG. 3 is a Perspective view of a magnetic element of the arc quenching device shown in FIG. 2.
Figure 4:
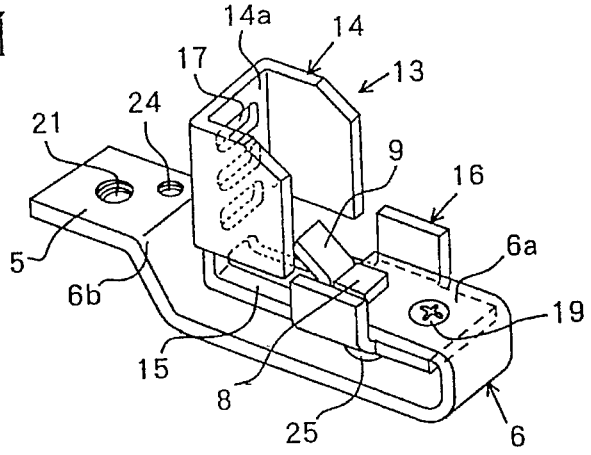
FIG. 4 is a perspective view in a state that the magnetic element shown in FIG. 3 is attached to a stationary contact member.
Figure 5:
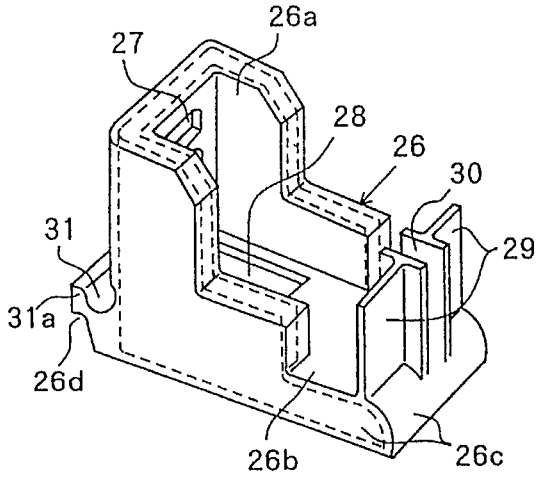
FIG. 5 is perspective view of an insulation cover in the arc quenching device shown in FIG. 2.
Figure 6:
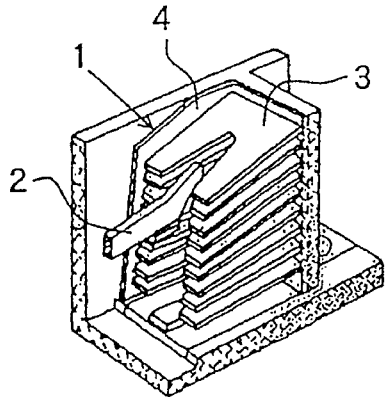
Fig. 6 PRIOR ART
FIG. 6 is perspective view of an arc quenching device in the prior art.
Figure 7:
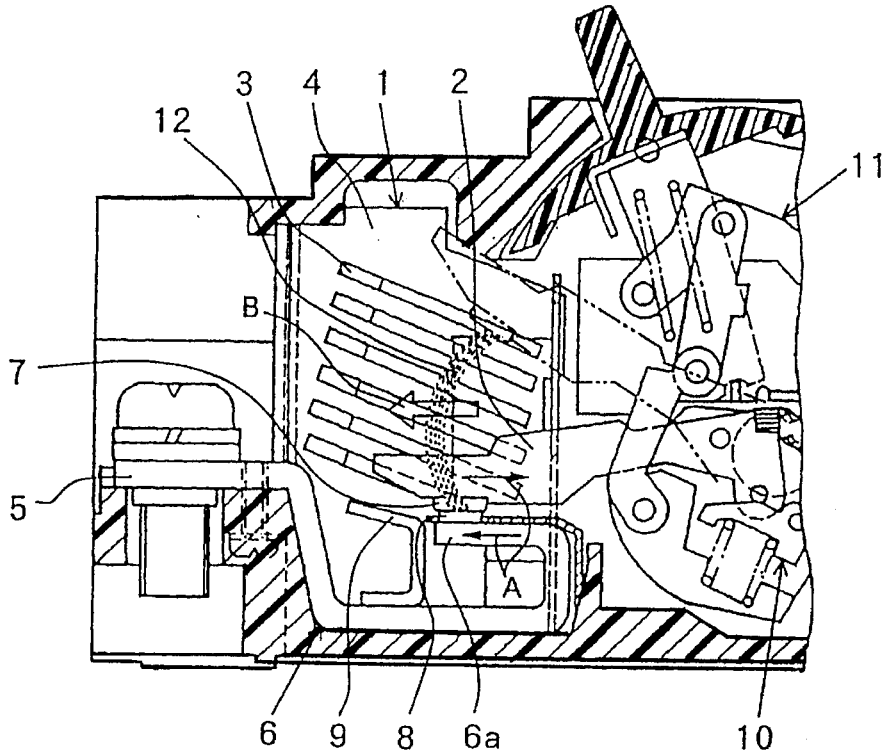
Fig. 7 PRIOR ART
FIG. 7 is a longitudinal section view of a main portion of a breaker having the arc quenching device shown in FIG. 6.

FIGS. 1 to 5 show an embodiment of the present invention. FIG. 1 shows a longitudinal section view of a circuit breaker at a side of a power supply in on-condition; FIG. 2 is a perspective view of an arc quenching device of FIG. 1; FIG. 3 is a perspective view of a magnetic element of FIG. 1; FIG. 4 is a perspective view of the magnetic element shown in FIG. 3 which is pointed to a stationary contact member: and FIG. 5 is a perspective view of an insulation cover to be mounted on the magnetic element shown in FIG. 4. Throughout these figures the parts corresponding to those of the prior art of FIGS. 6 and 7 are designated by the same reference numerals.

At first in FIG. 3, a magnetic element 13 made of a steel plate is comprised of an arc quenching core 14 and a base plate 15. The arc quenching core 14 includes a back wall 14*a* and two side walls 14*b* extending from both sides of the bask wall 14*a*, which is similar to U or C shade in a horizontal section. The base plate 15 extends horizontally from the back wall 14*a* of the arc quenching core 14. Both sides of the base plate 15 are bent up into a U-shape so that a magnetic driving core 16 is integrally formed therewith. In the vicinity of the magnetic driving core 16, a Dart of the base plate 15 is cut and bent obliquely upward so as to form an arc horn 9 integrally. In the back wall 14*a* of the arc quenching core 14, several oblong exhaust openings 17 (3 openings in the figure) are provided for exhausting arc gas. On the other hand, a screw hole 18 for fixing the magnetic element 13 to a stationary contact member 6 is provided at the base plate 15. This magnetic element 13 is easily made by press forming.

As shown in FIG. 4, the magnetic element 13 is combined with the stationary contact member 6 so that the base plate 15 contacts the lower surface of the bent back part 6*a*, and is fixed to the stationary contact member 6 with a screw 19 which is screwed into the screw hole 18 through a hole (not shown) opened in the bent back part 6*a*. In this state, the magnetic driving core 16 formed in the base plate 15 encloses a stationary contact 8 attached on an end of the bent back part 6*a*, and the arc horn 9 extends from the stationary contact 8. A power supply terminal 5 integrally formed with the stationary contact member 6 has a screw hole 21 for a terminal screw 20 (shown in FIG. 1) and a screw hole 24 for a screw 23 (shown in FIG. 1) used for fixing the stationary contact member 6 to a case 22. In the stationary contact member 6, as described later, a passing hole 25 is provided for allowing a support column 22*a* of the case 22 to pass therethrough to support the bent back part 6*a*.

An insulation cover 26 shown in FIG. 5 is made of arc-resistant resin, e.g. polyester premix, by unitary molding. This insulation over 26 is provided with a double wall bag part 26*a* covering the arc quenching core 14 and the magnetic driving core 16 together, a plate part 26*b* covering the upper surface of the bent back part 6*a* of the stationary contact member 6, and a skirt part 26*c* covering a U-shaped bent of the bent back part 6*a* and both sides of the base plate 15 in the magnetic element 13. Further, exhaust openings 27 are opened in a back wall of the bag part 26*a* so as to fit with the exhaust openings 17 of the arc quenching core 14, and a rectangular hole 28 is provided in the plate part so that the stationary contact 8 and the arc horn 9 can pass through the rectangular hole 28.

A shield plate 29 is formed at an end of the insulation cover 26 so as to separate the arc quenching device from a switching mechanism 11 (shown in FIG. 1), and an opening 30 is formed in the shield plate 29 for allowing the moving contact member 2 (shown in FIG. 1) to pass therethrough. Moreover, in the insulation cover 26, a bearing ditch 31 having a semicylindrical bottom for supporting an exhaust valve (described later) is formed to contact the back wall of the bag part 26*a*. The insulation cover 26 is cut off at a corner near the bearing ditch 31 as shown in the figure, so that a connecting part 6*b* (FIG. 4) used for attaching the stationary contact member 6 to the power supply terminal 5 can pass therethrough.

FIG. 2 shows the state in which the insulation cover 26 in FIG. 5 is mounted on the stationary contact member 6 and the magnetic element 13 shown in FIG. 4. In this case, an exhaust valve 32 is attached to the bearing ditch 31 of the insulation cover 26. The exhaust valve 32 is made integrally of elastic heat resistant resin, and includes a valve flap 32*a* with a square plate form, a cylindrical haft part 32*b* as a base of the valve flap 32*a*, and an elastic piece 32*c* with a tongue shape which obliguely protrudes upward from the shaft part 32*b*. When the shaft part 32*b* is inserted into the bearing ditch 31, the elastic piece 32*c* touches an upper edge 31*a* of the bearing ditch 31 and receives a force toward the bag part 26*a*, and then, the valve flap 32*a* shuts the exhaust openings 27 by contacting the back wall of the bag part 26*a*.

In assembling the circuit breaker shown in FIG. 1, at first, parts of the device are sub-assembled into the state shown in FIG. 2. That is, the stationary contact member 6 is combined with the magnetic element 13, to which the insulation cover 26 is mounted, and the exhaust valve 32 is attached to the insulation cover 26. Thereafter, the stationary contact member 6 is inserted into the case 22 and screwed with the screw 23 into the screw hole 24 from the rear side. The support column 22*a*, which is integrally molded on the bottom of the case 22, contacts the lower surface of the base plate 15 of the magnetic element 13 through the passing hole 25 (FIG. 4) of the stationary contact member 6, and supports the bent back part 6*a* from the under side against a shock by the moving contact member 2. At last, when a cover 33 is mounted on the case 22, the insulation cover 26 is fixed and held by the cover 33 at four spots of the bag part 26*a*, i.e. the front and rear of right and left sides.

In FIG. 1, when a large current, such as short-circuit current, flows through the circuit breaker, the moving contact member 2 is sprung up by an electromagnetic repulsion force acting between the currents flowing in the opposite directions with one another through the bent back part 6*a* of the stationary contact member 6 and the moving contact member 2, as shown in the arrow A. Then, the moving contact member 2 is instantly driven to an opened position shown by a chain line in FIG. 1 by the action of the current limiting mechanism 10. At that time, magnetic flux caused by the current flowing through the bent back part 6*a* of the stationary contact member 6 is concentrated at the magnetic driving core 16, and a strong magnetic field occurs between both poles of the magnetic driving core 16 (both ends of the U-shaped standing-up parts). Therefore, an arc 12 is urged toward the direction shown by an arrow B, wherein at an early stage of separating the moving contact member 2 from the stationary contact member 6, a foot of the arc moves to the arc horn 9. In this case, since the periphery of the stationary contact 8 and the magnetic driving core 16 are insulated by the insulation cover 26 as shown in the figure, the unstable arc 12 is prevented from ignition in these parts, and is surely led to the arc horn 9.

Next the arc 12 approaching the arc quenching core 14 is pushed into a magnetic path of the arc quenching core 14 and restricted in this state, since a magnetic flux of the arc itself is dragged in the C-shape magnetic path of the arc quenching core 14. While restricted, the arc 12 is elongated in accordance with progress of opening the moving contact member 2, and cooled at the arc quenching core 14. As a result, arc voltage becomes high, and then the arc 12 is quickly quenched. Since the arc quenching core 14 is structured to surround the arc 12, the arc quenching core 14 contacts the arc 12 far less when comparing with the magnetic plates 3 intersecting perpendicularly to an arc in a de-ion type arc quenching device (FIG. 6). Besides, when the arc quenching core 14 is insulated with the insulation cover 26 as shown in the figure, melting of the arc quenching core 14 by contacting the arc 12 never occurs. Furthermore, when the insulation cover 26 is made of a material generating thermally decomposed gas, such as nylon 66, polyacetal copolymer resin or the like, this thermally decomposed gas promotes cooling of the arc, and quenching of the arc can be promoted.

In cutting or breaking the current described above, when an inner pressure of the device in the periphery of the arc quenching device rises by the generation of the arc gas, the exhaust valve 32 receiving this gas pressure is opened toward outside by deforming the elastic piece 32*c*, and the arc gas is exhausted through the exhaust openings 17 and 27. After the Gas pressure is decreased, the exhaust valve 32 closes the exhaust opening 27 again by restoring of the elastic piece 32*c*. The exhaust openings 17 and 27, and the exhaust valve 32 are appropriately provided in correspondence with the breaking capacity, and they may be unnecessary for circuit breakers of the small breaking capacity.

On the other hand, the shield plate 29 blocks invasion of the arc gas into the switching mechanism 11, and prevents the mechanism from being damaged by a high-temperature gas and also prevents the moving parts from failing to operate by adhering of melted particles of the contacts included in the arc gas. Therefore, it is preferable that the opening 30 in the shield plate 29 (FIG. 2) is made narrow close to the width of the moving contact member 2.

In the arc quenching device of the embodiment shown in the figures, the magnetic element 13 including the arc quenching core 14 has a simple structure, and can be easily made by press forming. And, since the magnetic element 13 including the arc quenching core 14 is seldom contacted with the arc 12 owing to the form and is entirely covered with the insulation cover 26, the metal particles are not substantially generated by melting. Furthermore, since the magnetic driving core 16 and the arc horn 9 are integrally formed in the magnetic element 13, an entire structure including these parts is far much simplified. Also, since the arc quenching device can be built into the case 22 in the state that the arc quenching device is sub-assembled together with the stationary contact member 6, assembling work is simplified.

According to the present invention, since the arc quenching device has a structure that the magnetic element, comprised of the arc quenching core of C-shape in its horizontal section and the base plate arranged crosswise to the back wall of the arc quenching core and extending horizontally, is attached to the bent back part of the stationary contact member through the base plate, the arc quenching device is easily manufactured by press forming. The arc quenching core of a C-shape is hardly damaged by an arc owing to its form and is entirely covered with an insulation cover. Therefore, contact failure of the contacts or operation failure of a switching mechanism seldom occur by spreading melted metal together with an arc gas.

Furthermore, if the above described magnetic element is integrally formed with the magnetic driving core and the arc horn, it becomes unnecessary to attach these parts separately to the stationary contact, and the arc quenching device having the enhanced arc driving force has a much simpler structure as a whole which simplifies its assembly work. That is, the arc quenching device of the present invention shows a high performance and reduces its cost. In particular, the effect is much valuable for the circuit breakers with a breaking capacity of 2.5 to 5 kA, wherein reducing of cost has been eagerly expected.

What is claimed is:

1. Arc quenching device for a circuit breaker having a stationary contact member and a moving contact member, comprising:

a magnetic element including an arc quenching core having a back wall with lateral sides and a lower side, and two side walls extending from the lateral sides of the back wall in a direction away from the back wall; and a base plate extending substantially perpendicularly from the lower side of the back wall in a direction as in the side walls, said base plate being fixed to said stationary contact member to connect the magnetic element thereto and having a U-shaped magnetic driving core situated near a stationary contact point of the stationary contact member and extending directly upwardly from the base plate to surround the stationary contact point, arc formed between the stationary contact member and the moving contact member being moved by magnetic driving force formed by the magnetic driving core to the arc quenching core to be quenched therein.

2. An arc quenching device as claimed in claim 1, wherein said base plate includes an arc horn integrally formed therewith and obliquely extending toward the back wall from a portion near the stationary contact point.

3. An arc quenching device as claimed in claim 2, wherein said arc quenching core is integrally formed with the base plate and formed of one metal sheet of the magnetic element.

4. An arc quenching device as claimed in claim 3, wherein said back wall includes exhaust holes therein so that arc gas can be exhausted outside the arc quenching core.

5. An arc quenching device as claimed in claim 4, further comprising an exhaust valve situated near the back wall at a side opposite to the stationary contact member, said exhaust valve having an elastic piece to urge the exhaust valve to contact the back wall.

6. An arc quenching device as claimed in claim 2, further comprising an insulation cover having a hole at a lower portion, said insulation cover substantially completely covering the back wall, two side walls and magnetic driving core while the arc horn and the stationary contact point pass through the hole to directly face the moving contact member.

7. An arc quenching device as claimed in claim 6, wherein said insulation cover includes exhaust openings corresponding to exhaust holes of the back wall to discharge exhaust gas therethrough.

8. An arc quenching device as claimed in claim 7, further comprising an exhaust valve having a shaft part, a valve flap extending from the shaft part to cover the back wall, and an elastic piece extending from the shaft part, said insulation cover having a bearing ditch to receive the shaft part therein so that the valve flap is urged toward the back wall by the elastic piece.

* * * * *

UNITED STATES PATENT AND TRADEMARK OFFICE

CERTIFICATE OF CORRECTION

PATENT NO. : 5,569,894

DATED : October 29, 1996

INVENTOR(S) : Naoshi Uchida, Akihiko Kohanawa, Masao Miura, Jun Oyama, Koji Asakawa It is certified that error appears in the above-indentified patent and that said Letters Patent is hereby corrected as shown below:

Column 1, line 63, change "Dart" to --part--;

Column 3, line 19, change "Perspective" to --perspective--;

line 30, before "breaker" insert --circuit--;

line 41, change "pointed" to --jointed--;

line 44, after "figures" add --comma--;

line 56, change "Dart" to --part--;

Column 4, line 17, change "over" to --cover--;

line 48, change "haft" to --shaft--; and

Column 5, line 56, change "Gas" to --gas--.

Signed and Sealed this

Fourth Day of February, 1997

*Attest:*

Bruce Lehman

BRUCE LEHMAN

*Attesting Officer*

*Commissioner of Patents and Trademarks*